US005680710A

United States Patent [19]

Carnwath

[11] Patent Number: 5,680,710

[45] Date of Patent: Oct. 28, 1997

[54] APPARATUS FOR FACILITATING ACCURATE POSITIONING

[76] Inventor: James R. Carnwath, 12024 86th Ave. SE., Kirkland, Wash. 98034

[21] Appl. No.: 600,800

[22] Filed: Feb. 13, 1996

[51] Int. Cl.[6] ..... G01D 21/00; E03D 11/00

[52] U.S. Cl. ..... 33/613; 33/645; 4/420

[58] Field of Search ..... 33/613, 614, 623, 33/644, 645, 533; 4/420, 661, DIG. 9

[56] References Cited

U.S. PATENT DOCUMENTS

| | | | |
|---|---|---|---|
| 2,968,872 | 1/1961 | Welles | 33/645 |
| 3,083,007 | 3/1963 | Campfield | 33/613 |
| 3,626,600 | 12/1971 | Gaither | 33/613 |
| 3,943,851 | 3/1976 | Inada et al. | 33/614 |
| 3,985,462 | 10/1976 | Didato | 33/644 |
| 4,280,279 | 7/1981 | Grundfest | 33/613 |
| 4,369,582 | 1/1983 | Pfeffer | 33/613 |

*Primary Examiner*—William A. Cuchlinski, Jr.
*Assistant Examiner*—Andrew Hirshfeld
*Attorney, Agent, or Firm*—Robert W. Jenny

[57] ABSTRACT

Guides or guide assemblies are detachably attached to the floor at the periphery of the base of a toilet, either by installing them before a toilet is removed or using a template which represents the base or by using appropriate measurements. The working faces of the guides of guide assemblies flare away from the space occupied by the toilet base so that a toilet being lowered into place in approximately the correct position contacts the working faces and is guided into the correct position on the floor. The guides are single pieces. The guide assemblies are each made of two interconnectable pieces, a base part and a spacer. The working face of a guide assembly is on the spacer and the spacer can be removed from the base when guidance is not required and it is useful to have the additional access provided by removal of the spacers.

2 Claims, 1 Drawing Sheet

FIG. 1
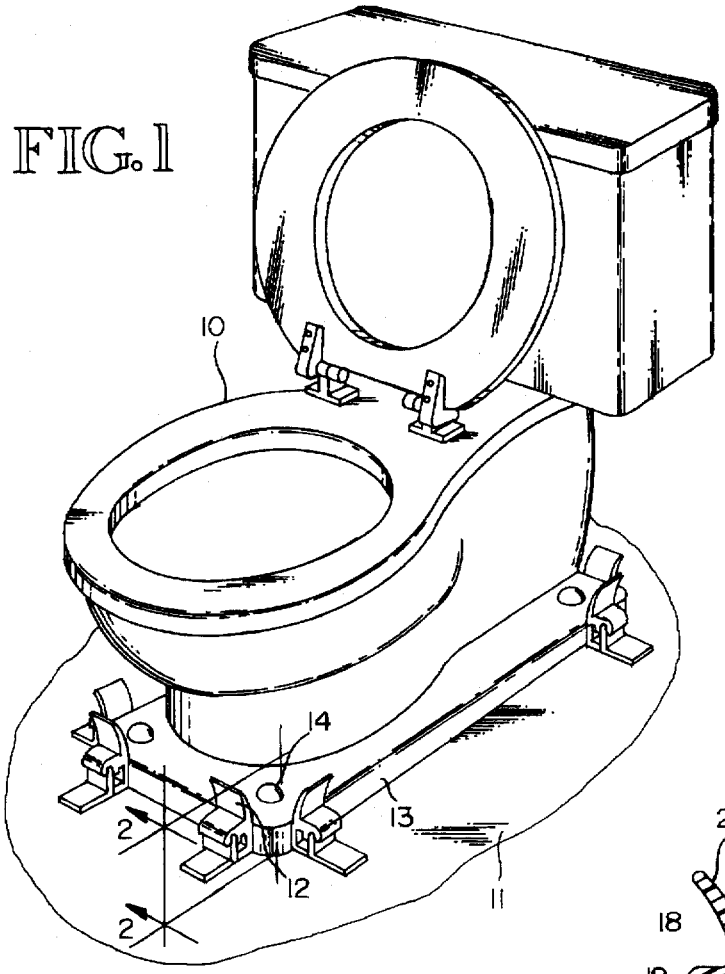
FIG. 2
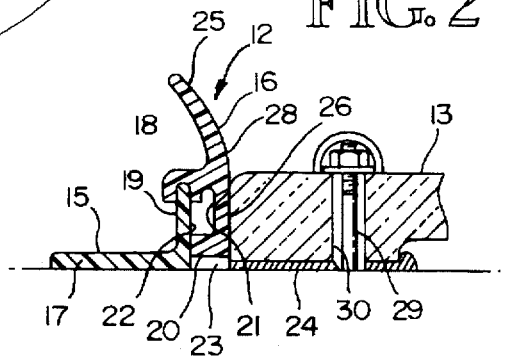
FIG. 3
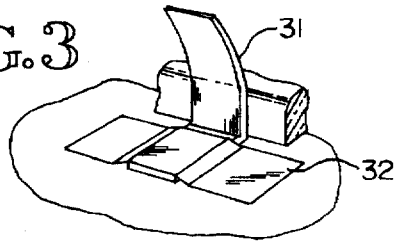
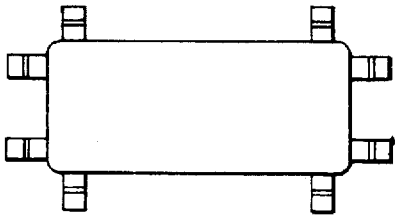
FIG. 4
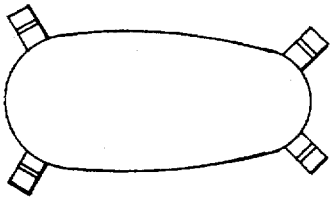
FIG. 5

APPARATUS FOR FACILITATING ACCURATE POSITIONING

BACKGROUND OF THE INVENTION

1. Field

The subject invention is in the field of gauges, guides, patterns and the like useful in facilitating the accurate positioning of items relative to one another or on a support surface such as a wall or floor. In particular it is in the field of such apparatus as used in the field of plumbing and more particularly in the field of installation of plumbing fixtures such as toilets. It is well known that it is often difficult to install a toilet so that there is no leakage at the connection to the sewer pipe and so that the fastening holes in the toilet base are properly aligned with the fasteners. Such an installation can be particularly difficult when a toilet is to be installed or replaced in a small space and near adjoining structures or a plumbing fixture such as a sink or bathtub. Toilets are cumbersome to handle and the toilet blocks the installer's view of where the toilet is being placed. It is recognized that the toilet must be accurately positioned on the first try for reasonable assurance that there will be no leaking.

2. Prior Art

The inventor of the subject invention knows of no commercially available prior art apparatus which simplifies the accurate positioning of a toilet during installation of the toilet. Accordingly, the primary objective of the subject invention is to provide apparatus which facilitates accurate positioning of a toilet during installation of the toilet. Further objectives are that the apparatus accommodate the wide variation in the shapes of toilet bases, be easy to use, and produceable at a cost which does not inhibit its commercial acceptance.

SUMMARY OF THE INVENTION

The subject invention is apparatus which facilitates accurate positioning of the base of a toilet during installation of the toilet. The apparatus comprises guides or guide assemblies shaped and located to engage the base of the toilet as it is lowered into the general area of installation and then guide it to the precise position in which it engages the gasket which is installed between it and its sewer connection and in which the fasteners fit through the fastener holes in the base. When a toilet is being removed and reinstalled the guides or guide assemblies are positioned against the toilet base before the toilet is removed. For a new installation a template is provided to indicate proper guide or guide assembly positioning. The guides or guide assemblies are held in place by pressure sensitive adhesive or by tape. Several guides or guide assemblies are used, their number and placement being dictated by the shape of the toilet base and the need to limit its position rotationally about a vertical axis and in two orthogonal directions. Each guide assembly comprises two parts, a base and a spacer. Each guide assembly or guide is positioned so that a working face of the guide or guide assembly is or will be against the toilet base. After guide assemblies are positioned the spacers are removed, leaving space between the guide assembly base parts and the area of contact of the toilet base on the floor. This space is needed for application of seating compound for the toilet. When the toilet is to be installed the spacers are reset on the guide assembly base parts. The working faces extend upward beyond the ends of the toilet fasteners and flare away from the toilet base. They engage the toilet base as the toilet is lowered and guide the base to the desired position.

Once the toilet is reinstalled the guides or guide assemblies are removed. it is important to keep the toilet base approximately level as the toilet is lowered into position so that all the working faces are contacted.

The invention is described in more detail below with reference to the attached drawings.

BRIEF DESCRIPTION OF THE DRAWINGS

FIG. 1 is a view of a toilet with the subject guide assemblies in place.

FIG. 2 is a section taken at 2—2 in FIG. 1.

FIG. 3 shows a guide held in place with tape.

FIG. 4 illustrates appropriate guide or guide assembly locations around a rectangular base of a toilet.

FIG. 5 illustrates appropriate guide or guide assembly locations around an oval shaped base of a toilet.

DETAILED DESCRIPTION OF THE INVENTION

The subject invention is apparatus for facilitating accurate positioning of a toilet base. The apparatus may comprise a plurality of one piece guides or a plurality of guide assemblies or some of each. In FIG. 1 toilet 10 is shown positioned on floor 11 by a plurality of guide assemblies, assembly 12 being typical. The assemblies are detachably attached to the floor with pressure sensitive adhesive and distributed around toilet base 13 to prevent its rotary or lateral displacement from its required orientation relative to the fasteners which attach it to the floor, fastener 14 showing, and to the plumbing for the toilet.

FIG. 2 is a section taken at 2—2 in FIG. 1 and illustrates the details of the guide assemblies. Assembly 12 comprises a base part 15 and a spacer 16. Horizontal flange 17 of the base part is attachably attached to the floor with pressure sensitive adhesive. Groove 18 of the spacer engages vertical flange 19 of the base part and flange 20 of the spacer sets the distance of face 21 of the spacer from surface 22 of the flange 19. Bottom surface 23 of the spacer does not touch the floor so that it will not engage bedding compound 24, often used in such installations. The height of tab 25 is such that as the toilet is lowered into place edge 26 of toilet base 13 will have contacted face 28 and been guided so that fastener 14 passes through hole 30. Face 28 slopes in the direction away from the space into which the toilet is to be installed.

FIG. 3 illustrates a guide 31 held in place by tape 32. In use with a toilet that is being removed and replaced the guide assemblies are installed with their faces 28 contacting the toilet base. The spacers are removed after the toilet is removed to provide working space for removing old bedding compound and replacing it with new compound. The spacers are reinstalled before the toilet is reinstalled.

For new installation a template is provided which keys onto the opening of the plumbing to which the toilet will be connected and has edge portions against which the bases of the guides or guide assemblies are set when they are installed. If a template is not available, guide or guide assembly base locations can be determined using measurements of the toilet base and the spacers.

FIG. 4 illustrates guide or guide assembly locations appropriate for a rectangular base of a toilet.

FIG. 5 illustrates guide or guide assembly locations appropriate for an oval base of a toilet.

It is considered to be understandable from the above description that the subject invention meets its objectives. It provides apparatus which facilitates accurate positioning of a toilet during installation of the toilet. The apparatus is easy to use and is inexpensive to manufacture since the parts can be made from extended material. The apparatus is adaptable to toilet bases of any shape.

It is also considered to be understood that while two embodiments of the invention are described herein, other embodiments and modifications of those described are possible within the scope of the invention which is limited only by the attached claims.

I claim:

1. An apparatus in combination with a toilet for facilitating accurate positioning of said toilet during installation of said toilet on a floor, said toilet having a toilet base, said toilet base having a periphery, said apparatus comprising a plurality of guides, said guides being detachably attached to said floor and positioned to define between said guides a shape corresponding to the shape of said periphery, such that when said toilet is lowered toward said floor and between said guides, said toilet base is guided rotationally about a vertical axis and laterally in two orthogonal directions, wherein when said toilet is lowered to said floor said toilet is accurately positioned on said floor, each of said guides having a guide base and a working face, each said working face extending upward from said floor and flaring away from said toilet base when said toilet is positioned between said guides.

2. An apparatus in combination with a toilet for facilitating accurate positioning of said toilet during installation of said toilet on a floor, said toilet having a toilet base, said toilet base having a periphery, said apparatus comprising a plurality of guide assemblies, said guide assemblies being detachably attached to said floor and positioned to define between said guide assemblies a shape corresponding to the shape of said periphery, such that when said toilet is lowered toward said floor and between said guide assemblies, said toilet base is guided rotationally about a vertical axis and laterally in two orthogonal directions, wherein when said toilet is lowered to said floor said toilet is accurately positioned on said floor, each of said guide assemblies comprising a base part and a spacer, said spacers spacing each said base part away from said periphery when said toilet is positioned between said guide assemblies, each said spacer being detachably attached to its respective said base part, said spacers each having a working face extending upward from said floor and flaring away from said toilet base when said toilet is positioned between said guide assemblies.

* * * * *